US008096099B2

(12) United States Patent
Krevald

(10) Patent No.: US 8,096,099 B2
(45) Date of Patent: Jan. 17, 2012

(54) CAPPING TORQUE HEAD AND METHOD OF CAP APPLICATION

(75) Inventor: Walter R. Krevald, Des Plaines, IL (US)

(73) Assignee: Diamond Machine Werks, Inc., Elk Grove Village, IL (US)

( * ) Notice: Subject to any disclaimer, the term of this patent is extended or adjusted under 35 U.S.C. 154(b) by 336 days.

(21) Appl. No.: 12/528,744

(22) PCT Filed: Apr. 11, 2008

(86) PCT No.: PCT/US2008/060052

§ 371 (c)(1),
(2), (4) Date: Aug. 26, 2009

(87) PCT Pub. No.: WO2008/128057

PCT Pub. Date: Oct. 23, 2008

(65) Prior Publication Data

US 2010/0101192 A1 Apr. 29, 2010

Related U.S. Application Data

(60) Provisional application No. 60/911,661, filed on Apr. 13, 2007.

(51) Int. Cl.
*B67B 3/20* (2006.01)

(52) U.S. Cl. ..... 53/490; 53/317; 53/331.5

(58) Field of Classification Search ..... 53/317, 53/316, 331.5, 490, 420, 484, 485
See application file for complete search history.

(56) References Cited

U.S. PATENT DOCUMENTS

| | | | | |
|---|---|---|---|---|
| 753,837 | A | 3/1904 | Barcus | |
| 2,719,444 | A | 10/1955 | Zeller | |
| 3,683,598 | A | 8/1972 | Van Ziup | |
| 4,277,929 | A | 7/1981 | Schindel | |
| 5,207,048 | A | 5/1993 | Wysocki | |
| 5,249,487 | A | 10/1993 | Armfield, IV | |
| 5,423,159 | A * | 6/1995 | Bankuty et al. | 53/317 |
| 5,467,527 | A | 11/1995 | Zanini et al. | |
| 5,479,762 | A * | 1/1996 | Bliss | 53/490 |
| 5,584,161 | A | 12/1996 | Zanini et al. | |
| 7,000,502 | B2 | 2/2006 | Belik | |
| 7,987,652 | B2 * | 8/2011 | Corniani | 53/317 |

FOREIGN PATENT DOCUMENTS

AU 630331 B * 10/1992

* cited by examiner

*Primary Examiner* — Thanh Truong
(74) *Attorney, Agent, or Firm* — James P. Hanrath

(57) ABSTRACT

A torque head assembly and method of capping effective to cap a variety of trigger spray cap bases or common caps to a spray bottle or container includes a drive roller mounted on a drive gear. The drive gear is in meshed gear communication with a plurality of train gears enclosed within a generally C-shaped driver housing wherein the a distal train gear engages a driven gear upon which a driven roller is mounted. An actuator allows the driver housing of torque head assembly to approach a variety of trigger spray cap bases or common caps within a plane generally horizontal thereto and at least partially co-planar therewith so as to capture the same between the dive roller and the driven roller and to thread mount the same onto the spray bottle or container.

16 Claims, 9 Drawing Sheets

SECTION A-A

SECTION B-B

SECTION C-C

SECTION D-D

SECTION E-E

CAPPING TORQUE HEAD AND METHOD OF CAP APPLICATION

CROSS-REFERENCE TO RELATED APPLICATION

This application claims priority to U.S. Provisional Patent Application 60/911,661 filed Apr. 13, 2007 and is a national phase entry of PCT/US08/60052.

TECHNICAL FIELD

The invention relates generally to capping machines, and more particularly, is directed to a capping torque head assembly and a method for assembling a threaded closure or cap on a threaded neck of a container or a bottle neck, especially spray valves or trigger sprayers having a fixed upper shroud and spout integral with a rotatable threaded cap base, such that the capping torque head is oriented in a predetermined generally horizontal plane relative to the cap base without interfering contact with the shroud or spout of the cap.

BACKGROUND ART

In conventional capping machines, a vertically operative chuck or capping head assembly having gripping jaws is provided for gripping a cylindrical cap and threading the cap onto the bottle neck. Specifically, the chuck is positioned in generally vertical alignment with the cap and is lowered along a downward path so as to grip with gripping jaws a threaded cap which is generally vertically aligned over a threaded bottle neck, whereupon the chuck is further lowered so as to position the cap on the bottle neck. The chuck is then rotated, thereby also rotating the cap and threading the cap onto the bottle neck. Thereafter, the chuck is vertically raised, and thereby removed from the cap, whereupon the assembled bottle and cap move to a next assembly station. See, for example, U.S. Pat. No. 3,683,598 to Van Zijp.

Yet, in several instances caps are formed with a shroud and spout that extends radially outward beyond the outer diameter of the cylindrical cap. Conventionally, the spout has been fixed with the cap. With this arrangement, when the cap rotates, the spout rotates with the cap.

An early practice was to mount such caps on bottles manually by an operator placing the bottles on a turntable and then screwing on the closure by hand. This requires considerable time and labor is not readily available for this type of work. In addition, the tightness of the closure is left to the feeling of the operator so that the bottles often are not tightly closed.

One effort to mechanize this operation have included an apparatus wherein pairs of cooperating friction wheels are mounted in the conveyor path of the bottles. The bottles with the closures are moved between the friction wheels which are spring-biased against each other to grip the closures. The friction wheels must run at a high rotary speed since the closures are held only briefly between the wheels. Even at high rotary speeds, it is not always possible to screw on the closures tightly during the brief period of time they are clamped between the friction wheels and, furthermore, the high rotary speed causes damage to the closures. It is impossible to exert a uniform, constant torque since each friction wheel has its own friction coupling. In addition, the structure is relatively complex and correspondingly expensive.

Other efforts include relatively complex machinery providing a vertically operative chuck or capping head assembly having gripping jaws adapted for gripping a cylindrical cap base and threading the cap base onto the bottle neck without interference from the shroud and spout. Such vertically operative chucks or capping head assemblies must subsequently be likewise able to disengage from the cap base without interference from the shroud and spout. To accomplish the foregoing the shroud and spout remain in the same relative position and the vertically operative chuck or capping head assembly requires relatively complex structure to allow movement of the gripping jaws. Exemplary of such vertically orientated approaches and attendant complex arrangements are U.S. Pat. No. 4,277,929 to Schindel, U.S. Pat. No. 5,207,048 to Wywocki, U.S. Pat. No. 5,467,527 to Zanini et al., and U.S. Pat. No. 5,584,161 to Zanini et al.

An embodiment of the invention provides a torque head assembly and method of capping which encounters a cap base from a generally horizontal plane with respect thereto thus avoiding many of the problems encountered in the above-outlined capping apparatus and the relatively complex machine structure previously associated with vertically operative chucks or capping head assemblies. Numerous other advantages and features of the invention will become readily apparent from the accompanying drawings and the following detailed description of the invention.

DISCLOSURE OF INVENTION

Embodiments of the invention advantageously provide for a torque head assembly for capping of a cap base to a container which includes a drive mount and a driver housing, the drive mount having a pivot point serving as a fulcrum for the driver housing and a drive shaft responsive to a drive mechanism. The drive shaft is operative to rotate a drive roller and a drive gear, the drive gear being adapted to power a plurality of train gears within the driver housing, the train gears being operative to rotate a driven roller and a driven gear. An actuator is operable to cause an approach of the driver housing to the cap base in a generally horizontal plane at least partially co-planar with the cap base and to allow the drive roller and driven roller to contact an outer periphery of the cap base and rotate the cap base into threaded engagement with the container.

Moreover, the torque head assembly for capping of a cap base to a container advantageously provides for a method of cap application to a container. The method includes the steps of providing a container and a cap base unconnected to the container in proximity to the foregoing torque head assembly, actuating the actuator to cause an approach of said driver housing to said cap base in a generally horizontal plane at least partially co-planar with said cap base, contacting an outer periphery of said cap base with said drive roller and driven roller, and rotating said cap base into threaded engagement with said container. The method preferably further includes the step of providing a sensor feedback of the mechanical grip torque during the rotating of the cap base into threaded engagement with the container.

BRIEF DESCRIPTION OF DRAWINGS

A fuller understanding of the foregoing may be had by reference to the accompanying drawings, wherein.

MODES FOR CARRYING OUT THE INVENTION

Figure 1:
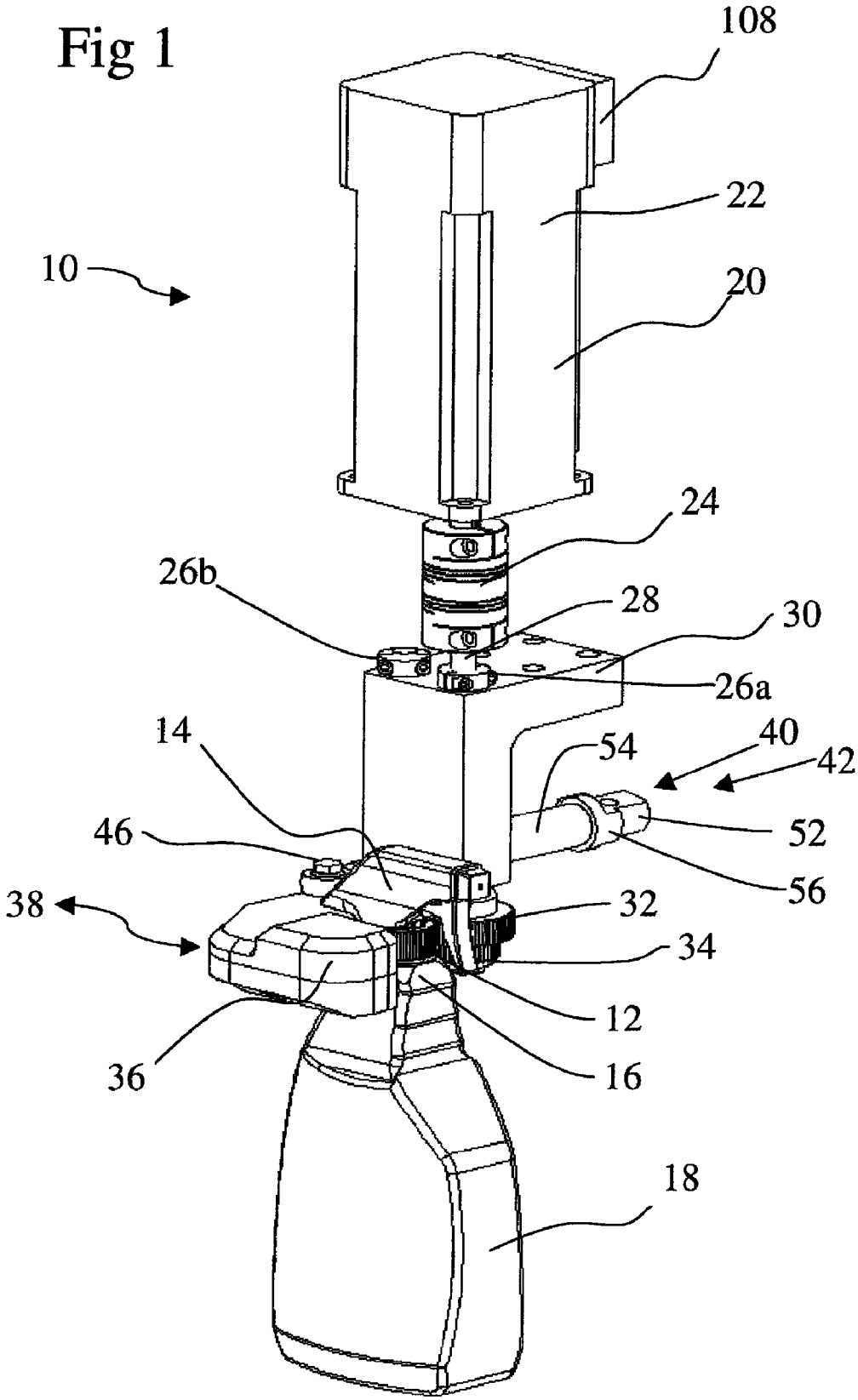
FIG. 1 is a front perspective view of a torque head assembly of an embodiment of the invention having a pneumatic actuator for capping a trigger sprayer cap base to its container bottle neck.

While the invention is susceptible to embodiments in different forms, there are shown in the drawings and will be described herein, in detail, the preferred embodiments of the invention. It should be understood, however, that the present disclosure is to be considered an exemplification of the principles of the invention and is not intended to limit the spirit or scope of the invention and/or claims of the embodiments illustrated.

Figure 2:
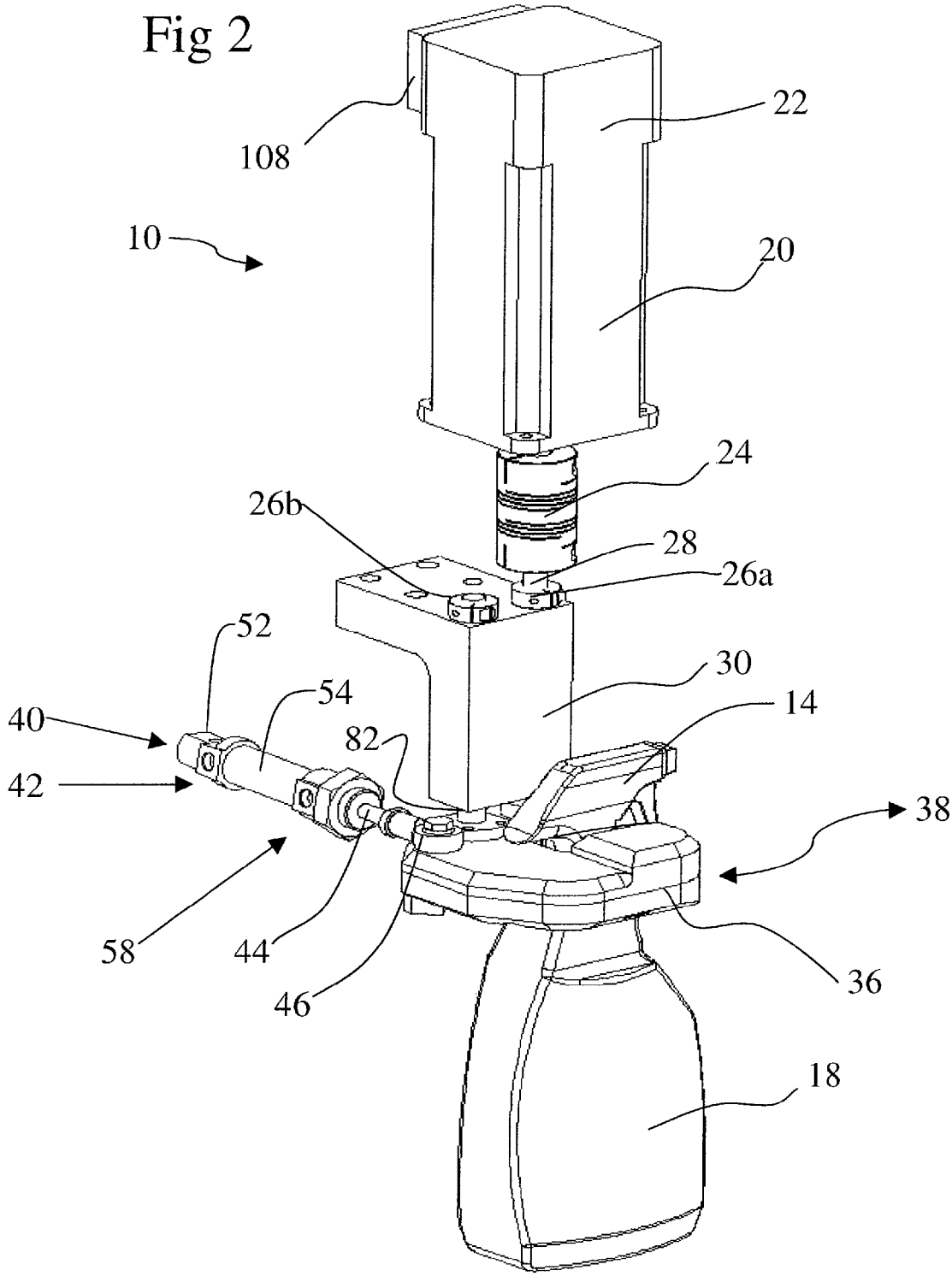
FIG. 2 is a rear perspective view of the torque head assembly of FIG. 1 capping a trigger sprayer cap base to its container bottle neck.

Referring now to FIGS. 1 and 2 there is shown, respectively, front and rear perspective views of a torque head assembly 10 of an embodiment of the invention capping a cap base 12 of a trigger sprayer 14 to the bottle neck 16 of a container 18. A power supply 20, such as the servo-motor 22 depicted, is cooperative with a motor coupling assembly 24 connected to one of the two bearing retainer collars (26*a*) to operate a drive shaft 28 within drive mount 30 and hence directly drive both a drive roller 32 and drive gear 34 to operate the drive gear train mechanisms within a driver housing 36. The power supply 20 may be one of several known drive means in the arts such as a regular motor, a magnetic brake clutch, a gear and friction clutch, or other suitable drive mechanism. The servo-motor 22 depicted is preferably used so as to drive the gears (hereinafter described) and provide a sensor feedback reading of the measured grip torque achieved by the gear train mechanisms of the driver housing 36 and drive and driven rollers (also hereinafter described) upon the outside periphery of a cap base of a trigger sprayer or a bottle cap for a container. Indeed, the torque head assembly 10 with its generally horizontal approach 38 of the driver housing 36 at least partially co-planar to cap base 12, entails far less mass as compared to the traditional complex structures associated with vertical capping operations, a factor conducive to more sensitive torque measurements and adjustments.

Figure 3:
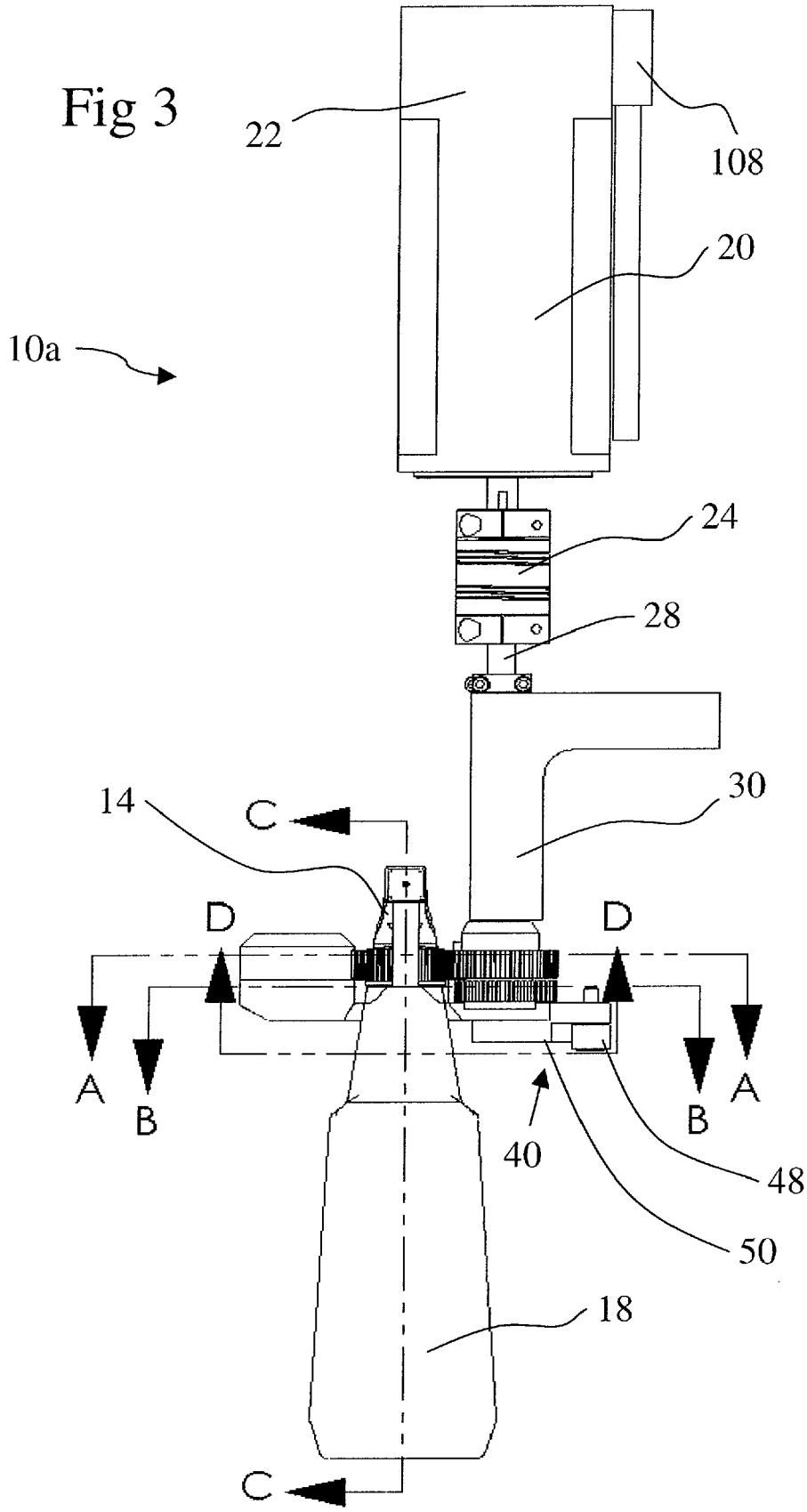
FIG. 3 is a front view of a torque head assembly of another embodiment of the invention similar to that of FIG. 1 but now having a cam actuator for capping a trigger sprayer cap base to its container bottle neck and now showing sectional lines A-A through D-D subject of FIGS. 4 through 7.

As best illustrated at FIG. 2, an actuator 40, such as pneumatic actuator 42 depicted, is operable to move a linearly extendable piston rod 44 interconnected with the driver housing 36 at connection 46 between retracted and extended positions to cause the generally horizontal approach 38 of the driver housing 36 at least partially co-planar to cap base 12 in a manner hereinafter more specifically described. The actuator 40 need not be pneumatic: it may also be cam or spring actuated such as the cam follower 48 cooperative with a follower arm 50. FIG. 3 (and its associated sectional views of FIGS. 4 to 7), FIGS. 8 and 9, and FIGS. 16 to 19 show the actuator 40 as cam follower 48 cooperative with a follower arm 50 to open and close or actuate the driver housing of the torque head assembly. The pneumatic actuator 42 of FIGS. 1 and 2 (also illustrated at FIGS. 10 to 15 and FIGS. 20 and 21) includes an actuator assembly drive end 52 connected to an actuator cylinder 54 housing the piston rod 44 by hex bolt 56. Thus pneumatic actuator 42 and actuator cylinder 54/piston rod 44 may be part of an overall pneumatic actuator assembly 58 to open and close the driver housing of the torque head assembly in a swing clamping action relative a trigger sprayer cap base as discussed hereafter. Although not illustrated for sake of clarity of presentation, the pneumatic actuator assembly 58 in turn can be affixed to a portion of the drive mount 30 or a suitable brace such as a rotary turret or a stationary platform.

The FIG. 3 front view of the torque head assembly 10*a* having an actuator 40 that is a cam actuator consisting of cam follower 48 cooperative with a follower arm 50 rather than a pneumatic actuator. FIG. 3 illustrates various sectional lines A-A through D-D which now will be described in relation to FIGS. 4 through 7.

Figure 4:
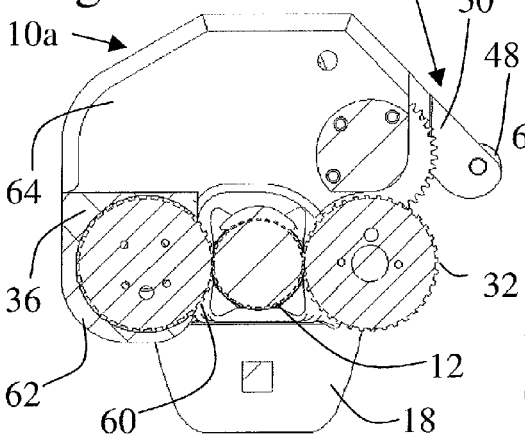
FIG. 4 is a horizontal sectional view of part of the torque head assembly and trigger sprayer cap base/container taken along section A-A of FIG. 3, namely through the center of the drive and driven rollers of a driver housing.
Figure 5:
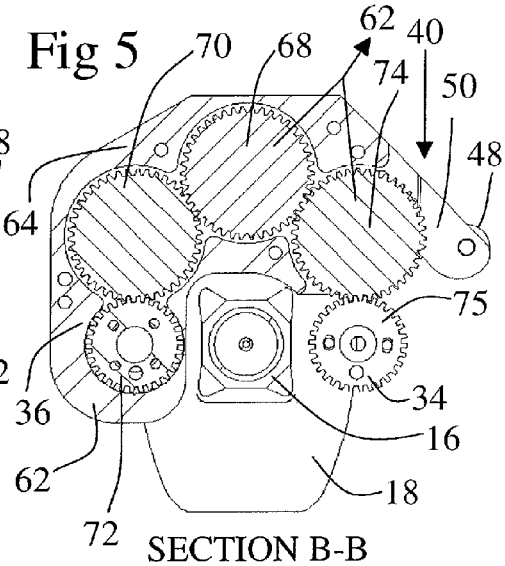
FIG. 5 is a horizontal sectional view of part the torque head assembly and trigger sprayer cap base/container bottle neck taken along section B-B of FIG. 3, namely through the center of the train gears of the driver housing.

Section A-A of FIG. 4 is a horizontal sectional view of part of the torque head assembly 10*a* and trigger sprayer cap base 12/container 18 of FIG. 1 through the center of drive roller 32 and a driven roller 60 that is at an end portion 62 of the driver housing 36. Section B-B of FIG. 5 is a horizontal sectional view similar to that of FIG. 4, but now taken through the center of a plurality of train gears 62 within the driver housing 36 of the illustrated portion of the torque head assembly 10 and illustrating bottle neck 16 of container 18. Operative rotation of drive shaft 28 within drive mount 30 rotationally drive powers drive gear 34 to operate the plurality train gears 62 within a train gear portion 64 of the driver housing 36 via their cooperative meshed teeth engagement. The plurality of train gears 62 of FIG. 5 includes a first proximal train gear 66, a second intermediary train gear 68, and a third distal train gear 70 each aligned in a common horizontal plane to rotationally operate a driven gear 72 located beneath its associated driven roller 60 of FIG. 4. The first train gear 66 is stationary and centered about a pivot point 74 which serves as a fulcrum for the entire driver housing 36 (inclusive of the driver housing train gear portion 64 and the driver housing end portion 62 that houses the driven gear 72 and most of its associated driven roller 60) for opening and closing about a cap base as will be hereinafter discussed. As seen in the horizontal sectional view of FIG. 5 the respective meshing teeth 76 of the drive gear, all first, second, and third train gears, and the driven gear are in the same general horizontal plane. The number of teeth per gear can vary depending upon the desired torque effect to be achieved.

Figure 6:
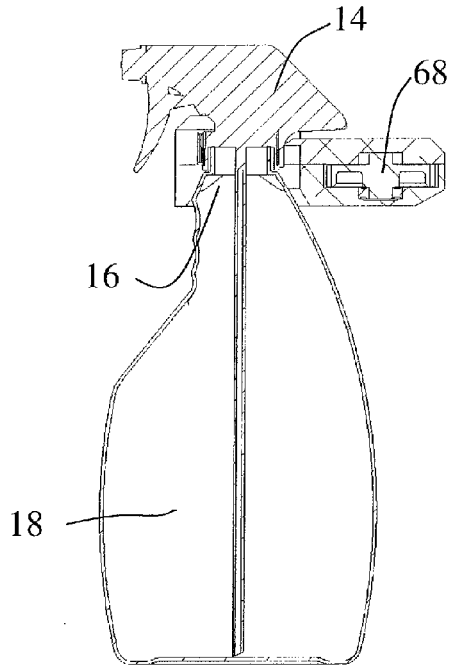
FIG. 6 is a vertical sectional view of a portion of the torque head assembly and trigger sprayer cap base/container bottle neck taken along section C-C of FIG. 3, namely through the vertical center-line of the trigger sprayer cap base/container.
Figure 7:
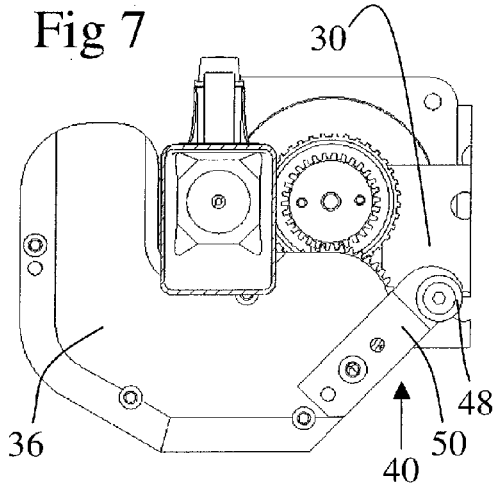
FIG. 7 is a horizontal sectional view of the torque head assembly, trigger sprayer cap base/container bottle neck, and drive mount taken along section D-D of FIG. 3.

Section C-C of FIG. 6 is a vertical sectional view of a portion of the torque head assembly and trigger sprayer cap base/container bottle neck taken along section C-C of FIG. 3, namely through the center of the trigger sprayer cap base/container. Section D-D of FIG. 7 is a sectional view of the torque head assembly, trigger sprayer cap base/container bottle neck, and drive mount taken along section D-D of FIG. 3.

Figure 8:
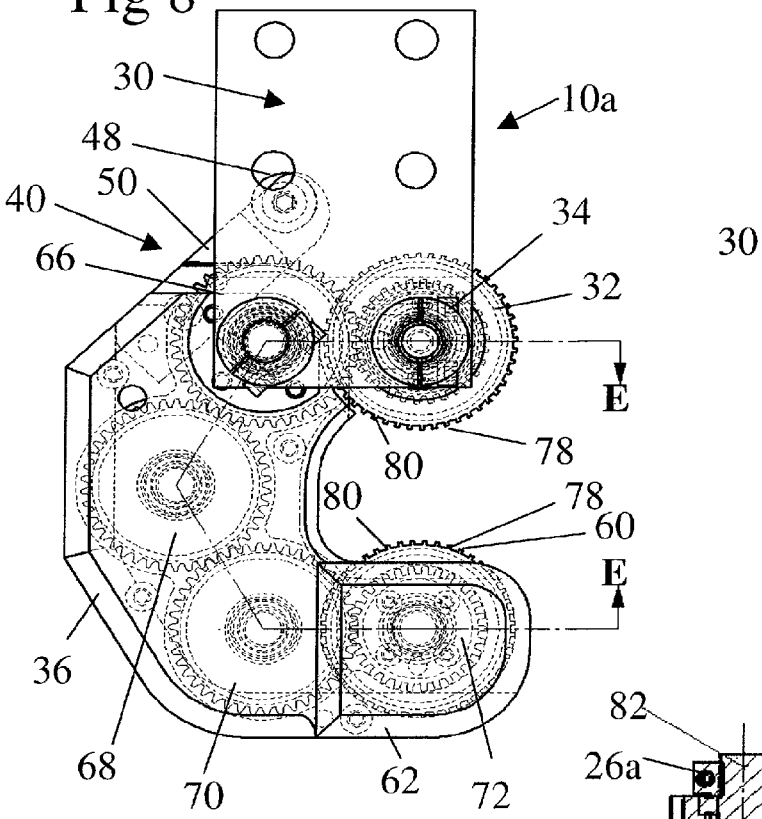
FIG. 8 is top horizontal sectional view of part of the torque head assembly of FIG. 3.
Figure 9:
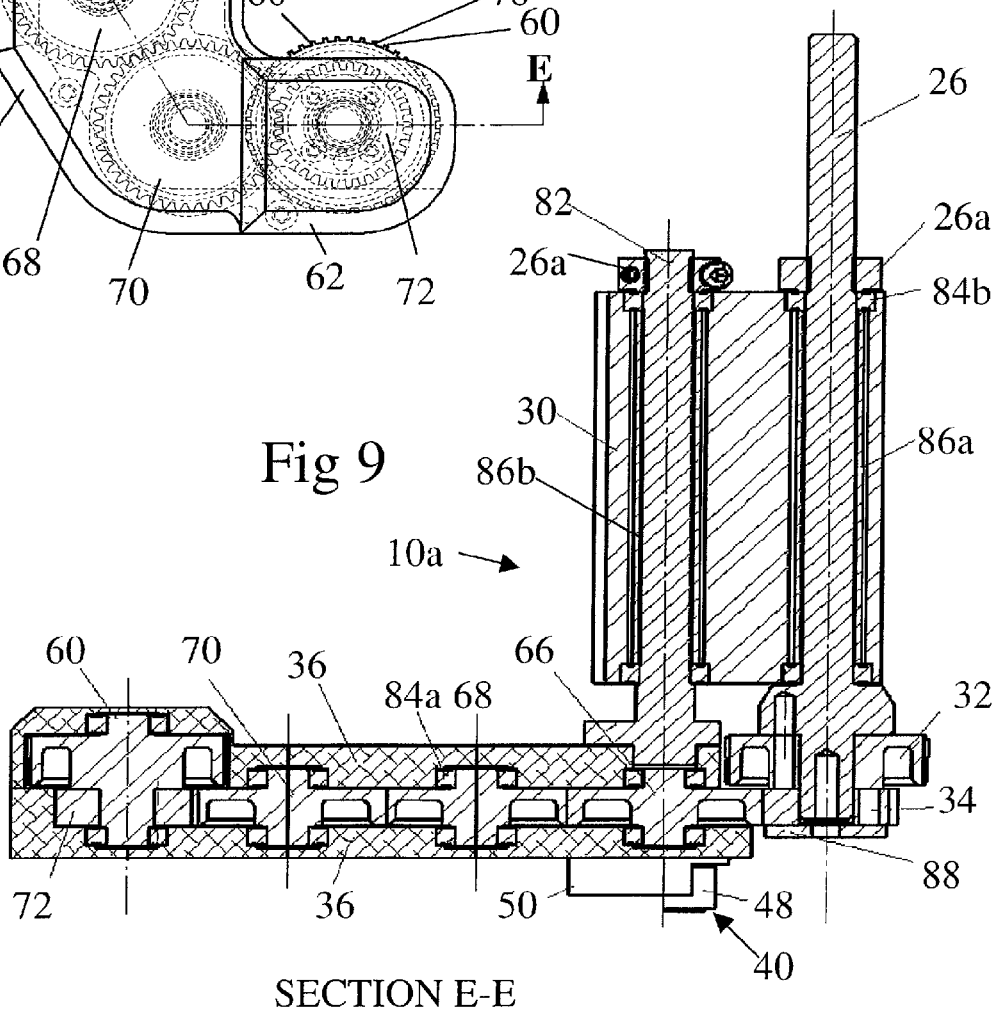
FIG. 9 is a cross-cut layout view of the portion of the torque head assembly of FIG. 8 taken along section E-E of FIG. 8.

FIG. 8 is top horizontal sectional view of a torque head assembly 10*a* of FIG. 3. which is cam actuated as opposed to having a pneumatic actuator. The cross-cut layout view of FIG. 9 is taken along section E-E of FIG. 8. In FIG. 8. the drive roller 32 and driven roller 60 are each mounted atop their respective drive gear 34 and the driven gear 72. When the torque head assembly 10*a* is in operative "capping" contact with the outer periphery of a cap base in the manner soon to be discussed, the drive roller 32 and driven roller 60 are oppositely aligned from each other so as to expose toward each other their respective serrations 78 of their outer annular periphery 80. These serrations 78 may be selectively numbered to be adapted for cooperative fitting and desirable torque effect with the outer annular periphery of the particular variable cap base to be capped to its associated container. Also in FIG. 8 the first proximal train gear 68 is stationary and centered about a pivot point 74 comprised of a vertical pivot shaft 82 secured in drive mount 30 by bearing retainer collar 26*b* (see FIG. 2). The driver housing 36 is substantially horizontal and perpendicular to the pivot shaft 82. It is noted that the pivot point of driver housing 36 is arbitrary and can be located, for example, at the drive gear 34.

The cross-cut layout view of FIG. 9 reflect various items of components and their respective quantities that may comprise the torque head assembly 10*a*, namely:

| ITEM | QTY | DESCRIPTION |
|---|---|---|
| 84a | 8 | BALL BEARING |
| 84b | 4 | BALL BEARING |
| 48 | 1 | CAM FOLLOWER |
| 36 | 1 | DRIVER HOUSING (BOTTOM) |
| 36 | 1 | DRIVER HOUSING (TOP) |
| 50 | 1 | FOLLOWER ARM |
| 62 | 3 | PLURALITY OF TRAIN GEARS |
| 28 | 1 | DRIVE SHAFT |
| 30 | 1 | DRIVE MOUNT |
| 82 | 1 | PIVOT SHAFT |
| 86a, 86b | 2 | CLAMP SPACER TUBE |
| 26a, 26b | 2 | BEARING RETAINER COLLAR |
| 34 | 1 | DRIVE GEAR |
| 88 | 1 | DRIVE GEAR COVER |
| 72 | 1 | DRIVEN GEAR |
| 60 | 1 | DRIVEN ROLLER |
| 32 | 1 | DRIVE ROLLER |

In FIG. 9, drive mount 30 is a block housing connected to a suitable brace (not shown) such as a rotary turret or a stationary platform having at its upper surface a pair of bearing retainer collars 26*a*, 26*b* atop ball bearings 84*b* which hold a drive shaft 28 and pivot shaft 82 respectively. The drive shaft 28 turns within one of two clamp spacer tubes 86*a* to provide direct rotation to both drive roller 32 and its associated drive gear 34 located below and disposed upon a drive gear cover 88. The rotation of driver gear 34 in turn drive powers the plurality of train gears 62, such as the first proximal train gear 66, the second intermediary train gear 68, and the third distal train gear 70 that rotationally operates the driven gear 72 located beneath its associated driven roller 60. As previously noted, the first train gear 66 is stationary and centered about a pivot point 74 in the form of pivot shaft 82 which serves as a fulcrum for the entire driver housing 36. As the first proximal train gear 66 turns, the associated pivot shaft 82 rotates within the other clamp spacer tube 86*b*.

Figure 10:
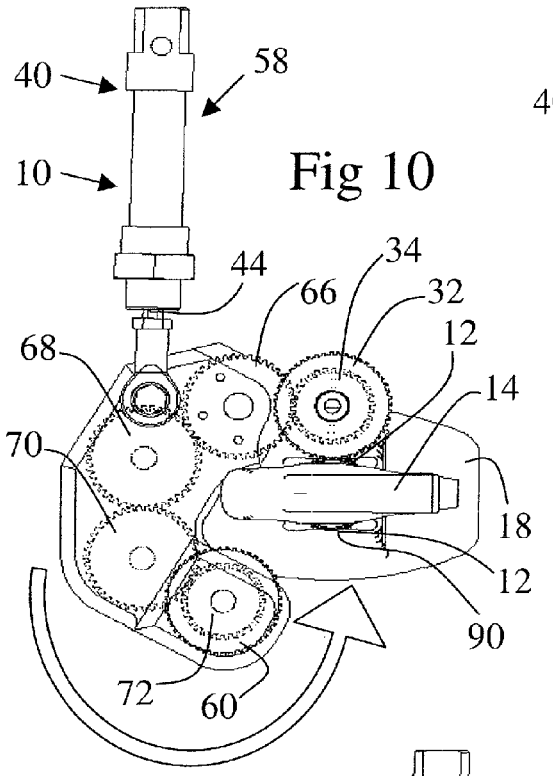
FIG. 10 is a top view of a trigger sprayer bottle when its cap base first contacts the drive roller of the drive gear to thereby initiate a pivoting of the driver housing (shown in sectional view) of the torque head assembly of FIG. 1.
Figure 11:
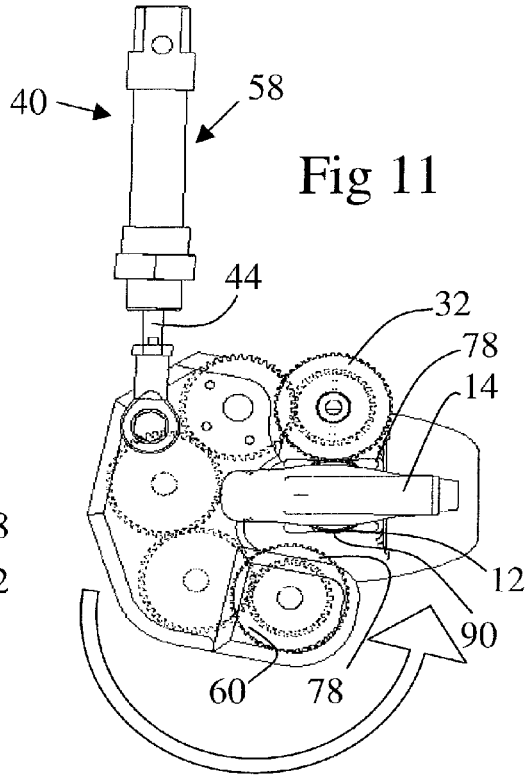
FIG. 11 is a top view of a trigger sprayer bottle when the pivoting of the driver housing (shown in sectional view) of the torque head assembly of FIG. 1 is at an intermediate position relative to the cap base.
Figure 12:
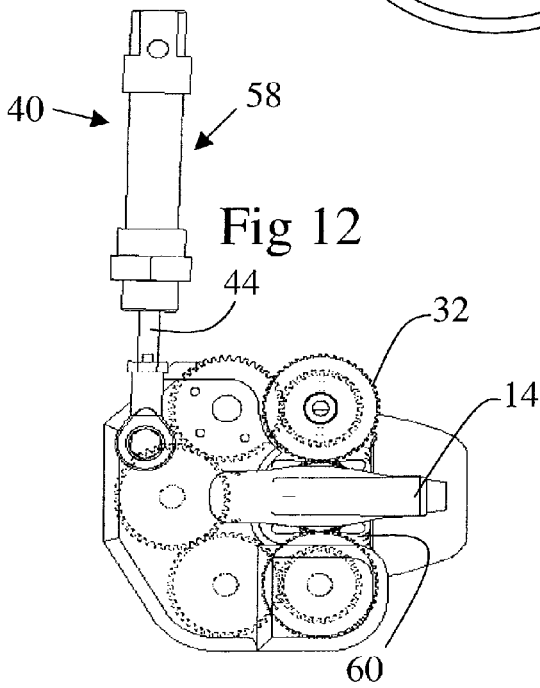
FIG. 12 is a top view a trigger sprayer bottle when the pivoting of the driver housing (shown in sectional view) of the torque head assembly of FIG. 1 is complete to capture the cap base for capping to its bottle neck.

FIGS. 10 through 12 shows the operation of the torque head assembly 10 of FIGS. 1 and 2 to encounter a cap base 12 of a supplied trigger sprayer 14 and spray bottle container 18 from a generally horizontal plane with respect to the cap base so as to thread mount the same on the container. In this regard, at FIG. 10 the torque head assembly 10 is in an initial open position relative to the spray bottle and trigger sprayer cap base. When a portion of the outer annular periphery 80 of drive roller 32 first contacts the outer annular periphery 90 of the cap base 12, the actuator 40 is activated to commence an outward linear advancement of piston rod 44 from its fully retracted position telescoped within the actuator cylinder 54 to an intermediary position as illustrated in FIG. 11 and then subsequently to a fully opened position of the actuator cylinder piston rod 44 defining a "capping" position of the driver housing 36 as illustrated in FIG. 12. The extension of the actuator cylinder piston rod 44 by virtue of its interconnection with the driver housing 36 via connection 46 provides a corresponding extension swing of the driver housing to enclose and capture the trigger sprayer cap base 12 in a clamping or wrap-around fashion in a generally horizontal plane 38 at least partially co-planar with the trigger sprayer cap base. The greater the length of the actuator cylinder 54 and its associated linear stroke of the actuator cylinder piston rod 44, the larger the percentage of swing opening the driver housing 36 of the torque head assembly 10 can accommodate. In FIGS. 10 through 12 the pneumatic actuator assembly 58 illustrated accommodates an opening of approximately 40° as might be suited for rotary turret applications of an embodiment of the invention, yet with an actuator cylinder 54 of greater length accommodating a greater length of an actuator cylinder piston rod 44 stroke, the driver housing 36 can accommodate a range of swing opening to 90°.

Regardless of the type of actuator 40, whether pneumatic or cam actuated, the degree of swing actuation of driver housing 36 may be designed for a rotary turret interaction with work pieces/containers or may be designed for a greater sufficient degree of swing sufficient for a linear conveyance line supply flow of such work pieces or containers. In either situation, the swing can be designed to accommodate between a position of withdrawal from interaction with a work piece or container to be capped so as to permit the supply of a further work piece or container in proximity to the driver housing 36 and its drive mount 30 and a position of interaction with respect to a particular supplied work piece or container for capping.

As the actuator cylinder piston rod 44 linearly extends from its fully retracted position within the actuator cylinder 54 in FIG. 10 to the inter mediate position of FIG. 11, the driven roller 60 moves within a plane generally horizontal to the cap base correspondingly closer toward the portion of the outer annular periphery 90 of the cap base 12 opposite its outer annular periphery that is engaged with the drive roller 32. Once the actuator cylinder piston rod 44 is fully extended to its final fully opened position of driver housing 36 of the torque head assembly 10 shown at FIG. 12 is in its "capping" position wherein the driven roller 60 contacts the foregoing opposite outer annular periphery 90 of the cap base 12 such that continued drive rotation of the drive gear 34, all train gears, and the driven gear rotates the cap base 12 (or another selectively chosen suitable threaded cap) into threaded engagement with its associated sprayer bottle or container. The drive roller 32 and driven roller 60 engages their respective opposite portions of the outer annular periphery 90 of the cap base 12 to screw the cap base in the same direction (clockwise for a left handed thread on the spray bottle and counter clockwise for a right handed thread on the spray bottle) to thereby thread mount the trigger sprayer 14 upon the spray bottle/container 18. The drive roller 32 thus stays in contact with its associated outer annular periphery 90 of the cap base 12 of the trigger sprayer 14 while the driven roller 60 swings around in a generally horizontal plane 38 at least partially co-planer fashion to the cap base 12 to ultimately achieve contact with the opposite outer annular periphery 90 of the cap base, thus avoiding contact with the upper body portion 92 or shroud housing 94 of the trigger sprayer 14 and thereby obviating the need for complex structure designed to avoid such work piece contact as found in traditional "vertical approaches" to capping a work piece. The number of serrations 78 to the outer side periphery 80 of the drive roller and driven roller is arbitrary and can be selected for its cooperative fitting and torque effect with the number of serrations on the outer side periphery of the work piece cap base or cap to be thread screwed to its associated spray bottle or container.

Figure 13:
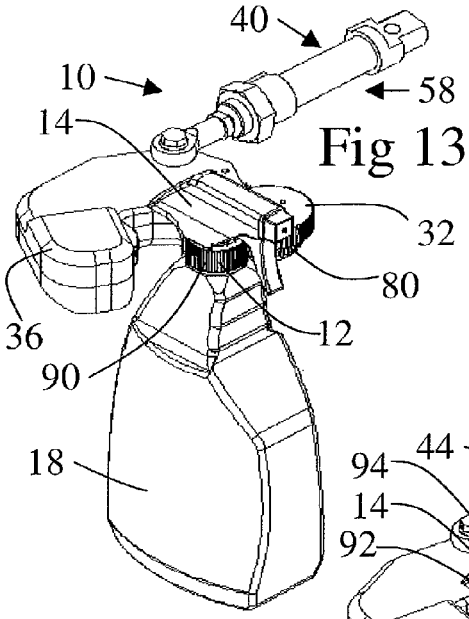
FIG. 13 is a top perspective view of the driver housing of the torque head assembly of FIG. 1 at a position of first contact with a trigger sprayer cap base.
Figure 14:
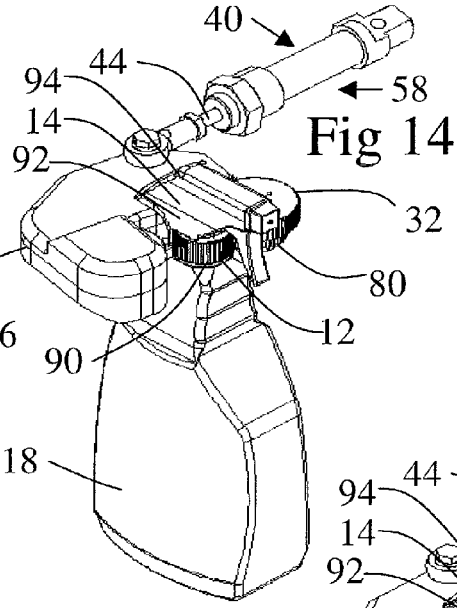
FIG. 14 is a top perspective view of the driver housing of the torque head assembly of FIG. 1 being actuated to an intermediate position after first contact with a trigger sprayer cap base.
Figure 15:
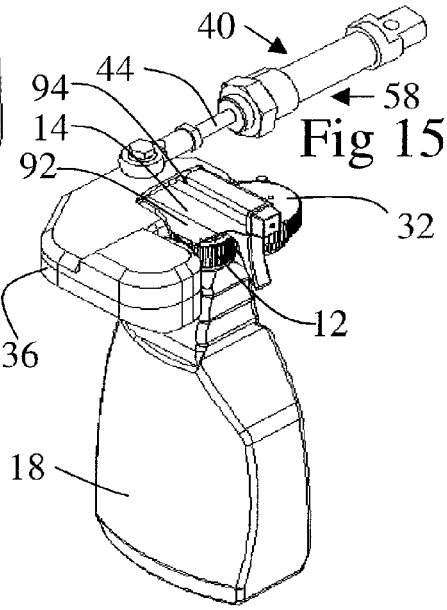
FIG. 15 is a top perspective view of the driver housing of the torque head assembly of FIG. 1 being actuated to a capping position to cap a trigger sprayer cap base to its bottle neck.

FIGS. 13 to 15 are front perspective views of the foregoing described horizontal plane capture of the cap base 12 of trigger sprayer 14 by the torque head assembly 10. FIG. 13 shows the driver housing 36 of the torque head assembly in its initial open position relative to the spray bottle 18 and the trigger sprayer cap base 12. FIG. 14 shows the intermediate position of the driver housing 36. FIG. 15 shows the "capping" position of the driver housing 36 of the torque head assembly engaged with the cap base 12 of trigger sprayer 14 wherein the actuator cylinder piston rod 44 is fully opened/extended and continued rotation of the drive roller 32 and driven roller 60 screws the cap base upon the spray bottle.

Figure 16:
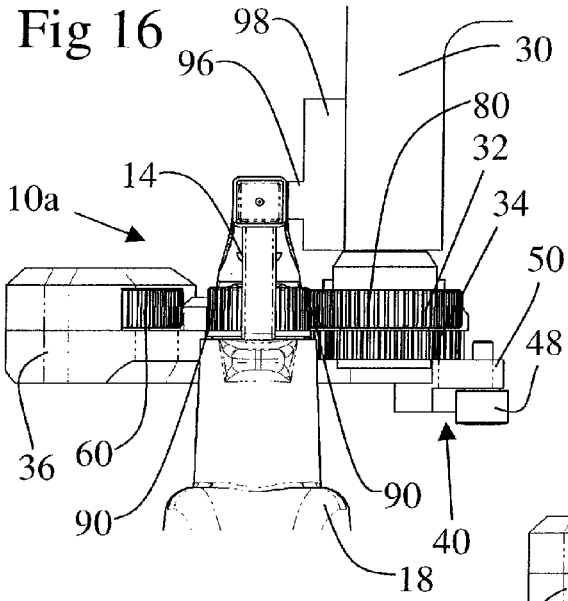
FIG. 16 is an upper front view of a torque head assembly of FIG. 3 wherein the trigger sprayer has been deflected to a face forward position relative to its bottle after contact with a stop block extension surface of the drive mount.
Figure 18:
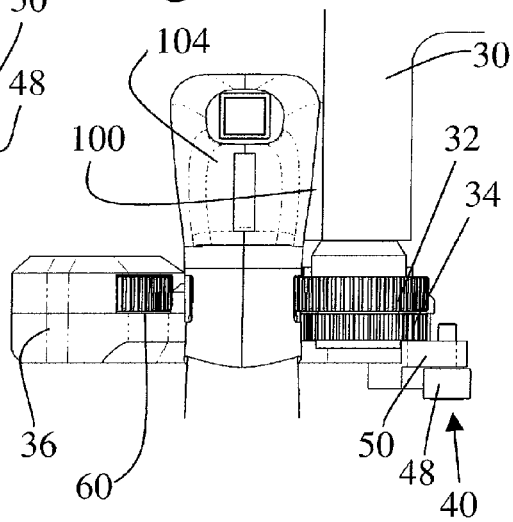
FIG. 18 is an upper front view of a torque head assembly of another embodiment of the invention similar to FIG. 16 except now illustrating, as an alternative to a stop block, the drive mount itself being effective to contact deflect a different, more complex and bulky, type of trigger sprayer to a face forward orientation relative to its bottle.
Figure 17:
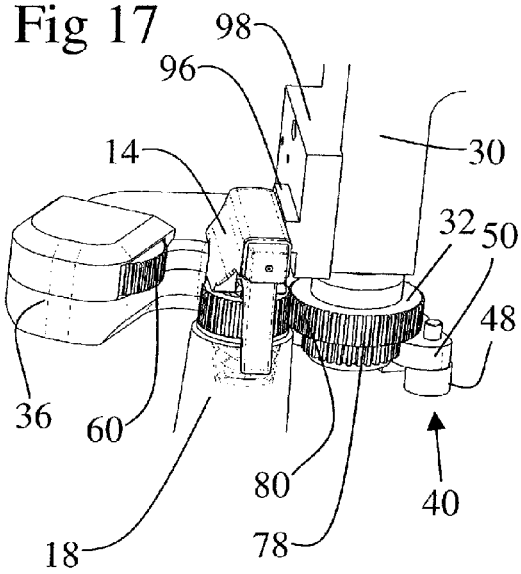
FIG. 17 is an upper front perspective view of a torque head assembly of FIG. 16 again showing the deflection of the trigger sprayer to a face forward position relative to its bottle after contact with a stop block extension surface of the drive mount.
Figure 19:
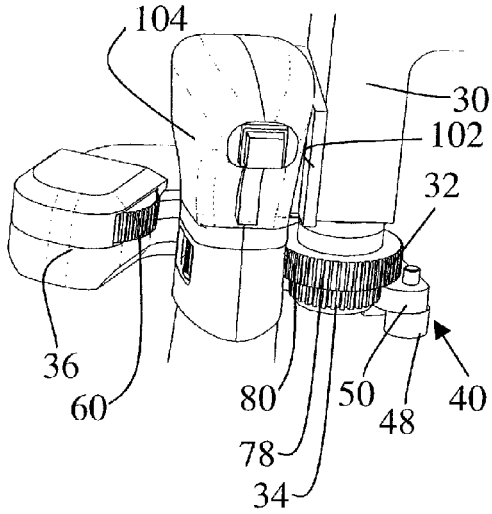
FIG. 19 is an upper front perspective view of a torque head assembly similar to that of FIG. 18 but now showing the deflection of the trigger sprayer to a face forward position relative to its bottle after contact with the an alternative flat stop block connected to an exterior surface of the drive mount.

FIGS. 16 and 17 shows two frontal views of the cam actuated torque head assembly 10*a*. In both the upper front view of FIG. 16 and the upper front perspective view of FIG. 17, the trigger sprayer 14 is depicted as having been deflected and aligned to a face forward position relative to its sprayer bottle 18 after its conveyance contact with a stop block extension surface 96 of an orientation surface block 98 of the drive mount 30. FIGS. 18 and 19 illustrates similar frontal views to that of FIGS. 16 and 17 except that the orientation surface block 98 and stop block extension surface 96 of the drive mount 30 depicted in FIGS. 16 and 17 are now replaced by alternative deflection structure, namely in the upper front view of FIG. 18 by an outer surface 100 of the drive mount 30 itself and in the upper perspective view of FIG. 19 by a flat orientation surface block 102 joined to the drive mount 30. The alternative deflection structure of drive mount outer surface 100 or drive mount flat orientation surface block 102 are each effectively suited to orientate a large shroud, more complex and bulkier trigger sprayer 104 in an aligned face forward orientated position relative to its spray bottle after its conveyance deflection contact. Thus a trigger sprayer not yet screwed to its associated spray bottle may during its conveyance in proximity to the torque head assembly 10*a* or 10*b* approach the drive mount outer surface 100 or the drive mount flat orientation surface block 102 or the stop block extension surface 96 of an orientation surface block 98 in various orientations relative the bottle to ultimately be deflected by such alternative deflection structure to a position parallel the drive mount 30 in an aligned face forward position.

Figure 20:
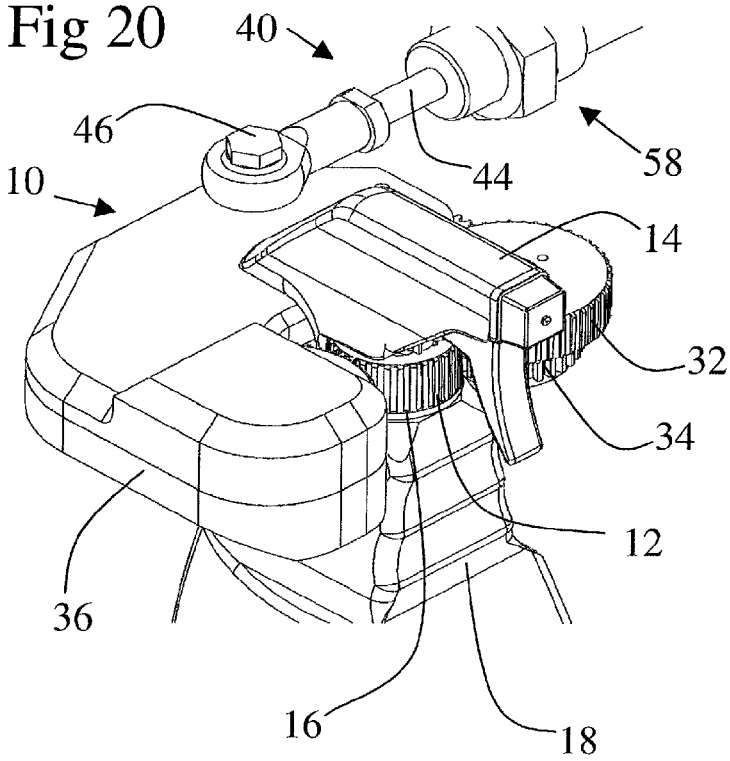
FIG. 20 is a top perspective view of the driver housing of the torque head assembly of FIG. 1 thread capping a trigger sprayer cap base to its bottle neck.
Figure 21:
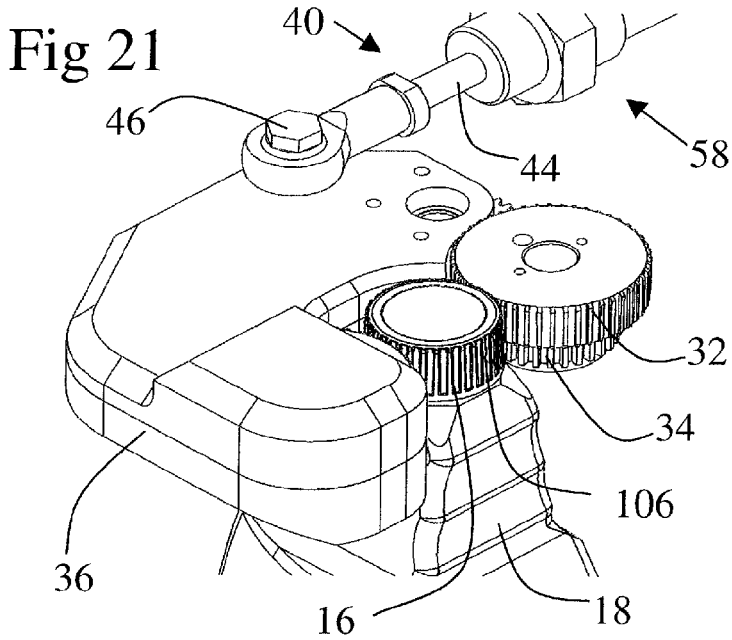
FIG. 21 is a is a top perspective view of the driver housing of the torque head assembly of FIG. 1 thread capping a common cap to its bottle neck.

Finally, in FIGS. 20 and 21 there is shown front perspective views of the driver housing 36 of the torque head assembly capping a trigger sprayer 14 onto a spray bottle 18 in FIG. 20 and a common flat head bottle cap 106 to a same bottle 18 in FIG. 21, each by virtue of the torque head assembly capture of the respective cap base 12 or cap 106 in a plane generally horizontal thereto.

From the foregoing, it is apparent that a method of capping may be achieved by the torque head assembly embodiments of the invention. For example a method of capping a cap base to a container may comprise the steps of: (1) providing a container 18 and a cap base 12 of a trigger sprayer 14 unconnected to the container in proximity to a torque head assembly 10 having a drive mount 30 and a driver housing 36, the drive mount having a pivot point 74 serving as a fulcrum for the driver housing 36 and a drive shaft 28 responsive to a drive mechanism 20, the drive shaft being operative to rotate a drive roller 32 and a drive gear 34, the drive gear being adapted to power a plurality of train gears 62 within the driver housing 36, and the train gears being operative to rotate a driven roller 60 and a driven gear 72, and an actuator 40 operable to move a linearly extendable piston rod 44 interconnected with the driver housing 36 by a connection 46 between retracted and extended positions, (2) engaging an outer periphery 90 of the cap base 12 with the drive roller 32, (3) activating the actuator 40 upon the engagement of the cap base 12 with the drive roller 32 to extended the piston rod 44 and cause the driver housing 36 to approach the cap base 12 in a generally horizontal plane 38 at least partially co-planar with the cap base, (4) contacting an outer periphery 90 of the cap base 12 with the driven roller 60 during the engagement of the cap base with the drive roller 32, and (5) rotating the cap base 12 into threaded engagement with the container 18. The method preferably further includes the step of providing a sensor feedback of the mechanical grip torque during the rotating of the cap base into threaded engagement with the container via servo-motor sensor 108 or other feedback means (see FIG. 1).

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

INDUSTRIAL APPLICABILITY

The torque head assembly and method of capping embodiments of the invention advantageously allows a drive roller to contact an outer periphery of the cap base of the trigger sprayer to activate an actuator to swing a driver housing having a driven roller around in a generally horizontal plane to the cap base, at least partially co-planer to the cap base, to ultimately achieve a clamping contact of the driven roller with the opposite side periphery of the cap base, thus avoiding contact with the upper body portion or shroud housing of the trigger sprayer and obviating the need for complex structure designed to avoid such work piece contact in traditional vertical approaches to capping a work piece or container. Additionally, the torque head assembly with its generally horizontal approach of the driver housing at least partially co-planar to the cap base entails far less mass as compared to the traditional complex structures associated with vertical capping operations, a factor conducive to more sensitive torque measurements and adjustments.

What is claimed:

1. A torque head assembly for capping of a cap base to a container comprising:

a drive mount and a driver housing, said drive mount having a pivot point serving as a fulcrum for said driver housing and a drive shaft responsive to a drive mechanism, said drive shaft being operative to rotate a drive roller and a drive gear, said drive gear being adapted to power a plurality of train gears within said driver housing, said train gears being operative to rotate a driven roller and a driven gear, wherein said plurality of train gears includes a first proximal train gear, a second intermediary train gear, and a third distal train gear each aligned in a common horizontal plane and said first proximal train gear is stationary and centered about said pivot point, and an actuator operable to cause an approach of said driver housing to said cap base in a generally horizontal plane at least partially co-planar with said cap base and to allow the drive roller and driven roller to contact an outer periphery of said cap base and rotate said cap base into threaded engagement with said container.

2. The torque head assembly of claim 1 wherein said drive mechanism is a motor, a magnetic brake clutch, a gear and friction clutch, or a servo-motor.

3. The torque head assembly of claim 2 wherein said drive mechanism is a servo-motor providing a sensor feedback of mechanical grip torque.

4. The torque head assembly of claim 1 wherein said pivot point comprises a vertical pivot shaft and said driver housing is substantially horizontal and perpendicular to said pivot shaft.

5. The torque head assembly of claim 1 wherein said drive roller is mounted atop said drive gear and said driven roller is mounted atop said driven gear.

6. The torque head assembly of claim 1 wherein said drive roller first contacts said outer periphery of said cap base and said driven roller subsequently contacts an opposite portion of said outer periphery of said cap base.

7. The torque head assembly of claim 1 wherein said wherein said drive roller and driven roller have serrations to their outer side periphery.

8. The torque head assembly of claim 7 wherein said serrations are numbered to be adapted for cooperative fitting and torque effect with said outer periphery of said cap base.

9. The torque head assembly of claim 1 wherein said drive mount forms a housing adapted for connected to a brace, rotary turret, or a stationary platform.

10. The torque head assembly of claim 1 wherein said drive mount further includes a surface block adapted to contact and orientate said cap base or container in an aligned position.

11. The torque head assembly of claim 1 wherein said actuator is operable to move a linearly extendable piston rod interconnected with said driver housing between retracted and extended positions, said movement of said piston rod to its extended position causing said approach and said extended position of said piston rod allowing the drive roller and driven roller to contact said outer periphery of said cap base for rotation of said cap base into threaded engagement with said container.

12. The torque head assembly of claim 1 wherein said actuator is pneumatic.

13. A method of capping a cap base to a container comprising:

providing a container and a cap base unconnected to said container in proximity to a torque head assembly having a drive mount and a driver housing, said drive mount having a pivot point serving as a fulcrum for said driver housing and a drive shaft responsive to a drive mechanism, said drive shaft being operative to rotate a drive roller and a drive gear, said drive gear being adapted to power a plurality of train gears within said driver housing, and said train gears being operative to rotate a driven roller and a driven gear, wherein said plurality of train gears includes a first proximal train gear, a second intermediary train gear, and a third distal train gear each aligned in a common horizontal plane and said first proximal train gear is stationary and centered about said pivot point, and an actuator operable to cause an approach of said driver housing to said cap base in a generally horizontal plane at least partially co-planar with said cap base, actuating said actuator to cause said approach, contacting an outer periphery of said cap base with said drive roller and driven roller, and rotating said cap base into threaded engagement with said container.

14. The method of claim 13 further including providing a sensor feedback of mechanical grip torque during said rotating of said cap base into threaded engagement with said container.

15. The method of claim 13 wherein said actuator is operable to move a linearly extendable piston rod interconnected with said driver housing between retracted and extended positions and is activated upon contact of said cap base with said drive roller.

16. The method of claim 15 wherein said movement of said piston rod to its extended position causes said driver housing to approach said cap base in said generally horizontal plane at least partially co-planar with said cap base.

* * * * *